US009895008B2

(12) United States Patent
Goppion

(10) Patent No.: US 9,895,008 B2
(45) Date of Patent: Feb. 20, 2018

(54) BELL-TYPE MUSEUM SHOWCASE, HAVING PANTOGRAPH LIFTING MECHANISMS

(71) Applicant: GOPPION S.P.A., Trezzano Sul Naviglio (MI) (IT)

(72) Inventor: Alessandro Goppion, Milan (IT)

(73) Assignee: GOPPION S.P.A., Trezzano sul Naviglio (Milan) (IT)

( * ) Notice: Subject to any disclaimer, the term of this patent is extended or adjusted under 35 U.S.C. 154(b) by 0 days.

(21) Appl. No.: 15/297,657

(22) Filed: Oct. 19, 2016

(65) Prior Publication Data

US 2018/0020846 A1 Jan. 25, 2018

(30) Foreign Application Priority Data

Jul. 22, 2016 (IT) ..... UA2016A5409

(51) Int. Cl.
*A47F 3/00* (2006.01)
*B66F 7/06* (2006.01)

(52) U.S. Cl.
CPC ..... *A47F 3/005* (2013.01); *A47F 3/002* (2013.01); *B66F 7/065* (2013.01)

(58) Field of Classification Search
CPC .. A47F 3/002; A47F 3/005; A47F 3/00; B66F 7/065; B66F 7/0666; B66F 7/0675
USPC ..... 312/114, 334.3, 306, 312
See application file for complete search history.

(56) References Cited

U.S. PATENT DOCUMENTS 2,429,723 A * 10/1947 Kelley ..... B66F 7/0625 254/9 R
2,850,344 A * 9/1958 Cook ..... G11B 33/04 312/272
2,862,689 A * 12/1958 Dalrymple ..... B66F 7/065 187/269
3,476,016 A 11/1969 Dixon et al.
5,733,021 A * 3/1998 O'Neill ..... A47F 3/002 312/114
6,053,590 A * 4/2000 Chang ..... H04N 1/00519 312/284
7,476,006 B2 * 1/2009 Hinds ..... F21S 8/028 362/153

(Continued)

FOREIGN PATENT DOCUMENTS

DE 949320 C 9/1956
EP 0389781 A1 10/1990

(Continued)

OTHER PUBLICATIONS

Search Report for IT UA201600077100 filed Jul. 22, 2016, Goppion S.P.A. dated Feb. 22, 2017. 7 pages.

*Primary Examiner* — James O Hansen
(74) *Attorney, Agent, or Firm* — Steinfl + Bruno LLP

(57) ABSTRACT

This showcase for the preservation and display of objects in a protected environment, comprises a bell, a base and pantograph mechanisms housed in lateral end regions of the base and formed by arms, pairs of arms and lower arms, the latter with a curvilinear configuration. The pantograph mechanisms are actuated by actuation systems housed at the bottom of the lateral end regions of the base. The showcase ensures an easier recovery of the space otherwise occupied by the actuation systems and at the same time an appropriate opening of the showcase.

2 Claims, 4 Drawing Sheets

(56) References Cited

U.S. PATENT DOCUMENTS

2012/0060291 A1* 3/2012 Gamman ..... A61G 13/009
5/611

FOREIGN PATENT DOCUMENTS

JP 2001017284 A 1/2001
JP 2015229048 A 12/2015
WO WO 2006/106083 * 10/2006

* cited by examiner

BELL-TYPE MUSEUM SHOWCASE, HAVING PANTOGRAPH LIFTING MECHANISMS

CROSS REFERENCED TO RELATED APPLICATIONS

The present application claims priority to Italian Application No. UA2016A005409 filed on Jul. 22, 2016, which is incorporated herein by reference in its entirety.

FIELD

The present invention relates to a museum showcase intended to be placed in a display place such as a museum, an exhibition or the like and intended for the preservation and display of objects of cultural heritage, such as works of art, historical artefacts and the like, in a protected environment. The term showcase will be sometimes used hereinafter for the sake of brevity, by this however always meaning a museum showcase.

BACKGROUND

Here and hereinafter, by protected environment it is meant an environment where the atmosphere is controlled, through the monitoring of one or more parameters including temperature, humidity, dust content, pollutant content, in order to maintain the foreseen preservation conditions of the exhibits, and in which access to unauthorized personnel is prevented to prevent theft or damage of the exhibits.

In general, there are museum showcases that comprise a bell formed by transparent walls welded together, a base and a mechanism that allows lifting the bell with respect to the base.

The lifting mechanism should ensure easy and wide opening of the showcase, so that the interior thereof is easily accessible, to place or remove the treasures or for cleaning or maintenance.

To this end, it is known to use pantograph mechanisms for lifting the bell, having movable arms hinged both together and with the base and the bell simultaneously. Such mechanisms can be actuated manually, with an electric motor or a hydraulic motor (such as hydraulic cylinders) so that through the movement of the movable arms, they ensure the lifting of the bell in vertical direction with respect to the base itself of the showcase.

Generally, the actuation systems of the pantograph mechanisms of the showcase, such as the electric motor or hydraulic motor, are placed in the lateral end regions of the showcase base, where the respective arms of the mechanism to be actuated are also accommodated, so as not to be visible when the showcase is closed.

Therefore, a problem exists of placing, preferably in the showcase base, both the pantograph mechanisms and the actuation systems thereof, so as to occupy as little space as possible and ensure adequate opening of the showcase.

Accordingly, the present invention relates to a museum showcase with features according to the claimed subject matter.

More in particular, the museum showcase comprises a base, a bell which can be lifted with respect to the base and pantograph mechanisms for lifting the bell having movable arms hinged together, lower arms hinged with the base and movable arms hinged with the bell, characterized in that lower arms of the pantograph mechanisms, which are hinged with the base, have a curvilinear configuration.

With these pantograph mechanisms having the lower arms with curvilinear configuration, it is easier to recover space otherwise occupied only by the actuation systems and at the same time an adequate opening of the showcase.

Preferably, the lower arms of the museum showcase have a concavity facing downwards.

Preferably, such lower arms of each pantograph mechanism define with their own curvilinear configuration a space in which a motor for the actuation of the pantograph mechanism is housed.

With this configuration, when closing the museum showcase, the lower arms of the pantograph mechanisms close up on the respective actuation system, thereby recovering the space between the actuation system and the lower legs of the museum showcase, thus ensuring a smaller overall footprint.

Preferably, the pantograph mechanisms are housed in the showcase, in lateral end regions of the base.

This housing allows making the pantograph mechanisms not visible when the showcase is closed, since the arms of the mechanisms are closed in the lateral end regions of the base, not visible to the observer from the outside.

BRIEF DESCRIPTION OF DRAWINGS

Further features and advantages of the invention will appear more clearly from the following description of a preferred embodiment of a showcase according to the invention, made with reference to the accompanying drawings. In such drawings.

DESCRIPTION

Figure 1:
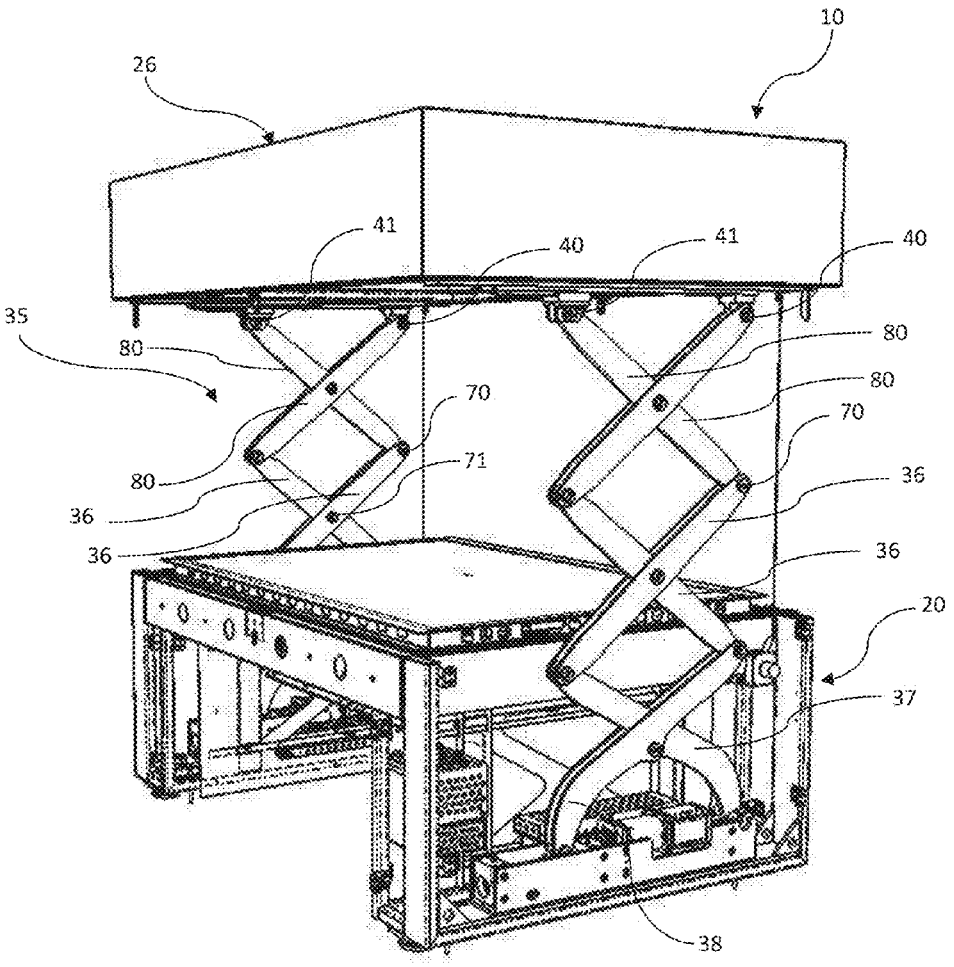
FIG. 1 is a perspective view of a showcase according to the invention.

In the figures, reference numeral 10 indicates as a whole a showcase according to the invention. Showcase 10 comprises a base 20, surmounted by a bell 26 consisting of transparent walls (typically glass) welded together, all indicated with reference numeral 30. In the example shown, showcase 10 is substantially parallelepiped-shaped and thus, there are five walls 30, four lateral walls and an upper wall. Showcase 10 comprises pantograph mechanisms 35, which allow lifting bell 26 with respect to base 20. Base 20 in turn comprises two lateral end regions 39, each housing one of the pantograph mechanisms 35, as shown in FIGS. 1 and 4.

Figure 2:
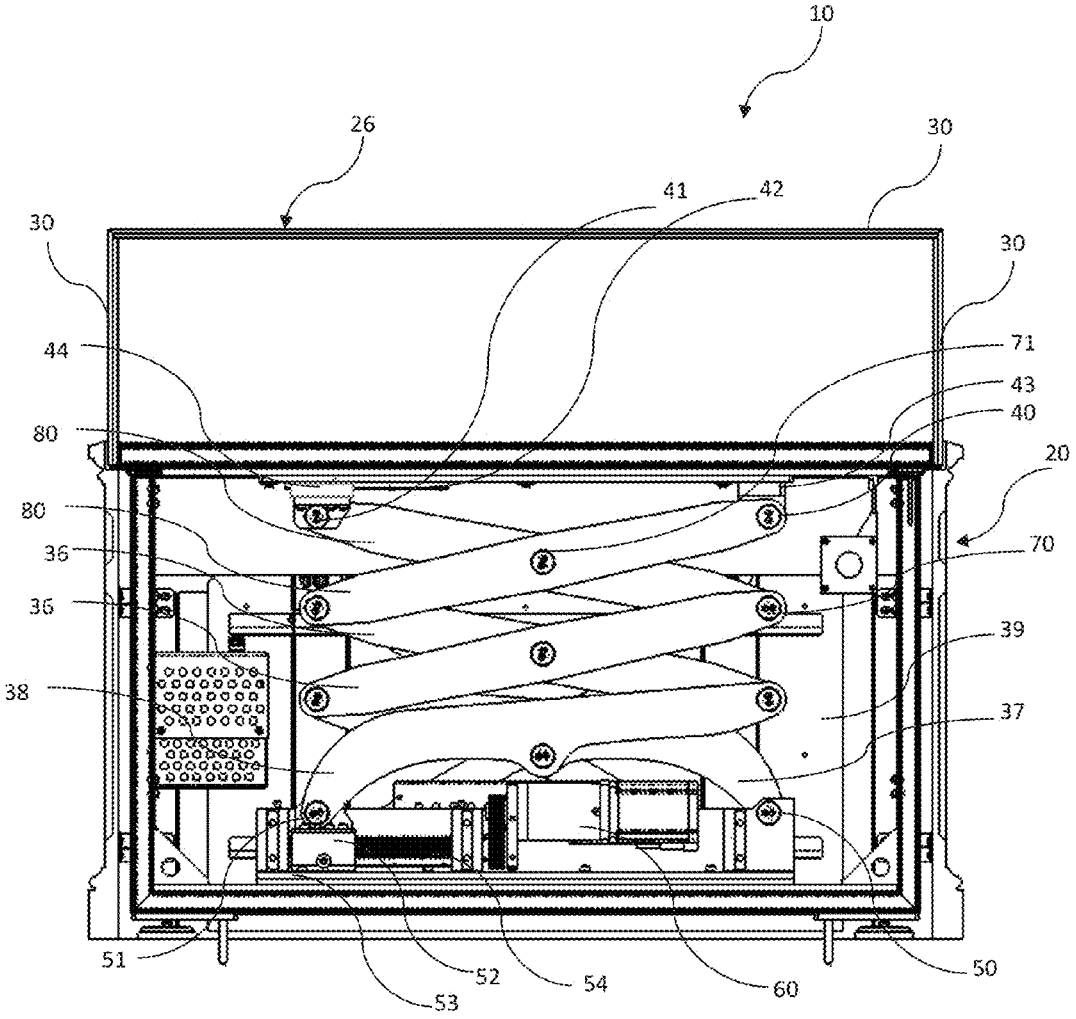
FIG. 2 is a sectional view of the showcase in FIG. 1 with one of the pantograph mechanisms in closed position.
Figure 3:
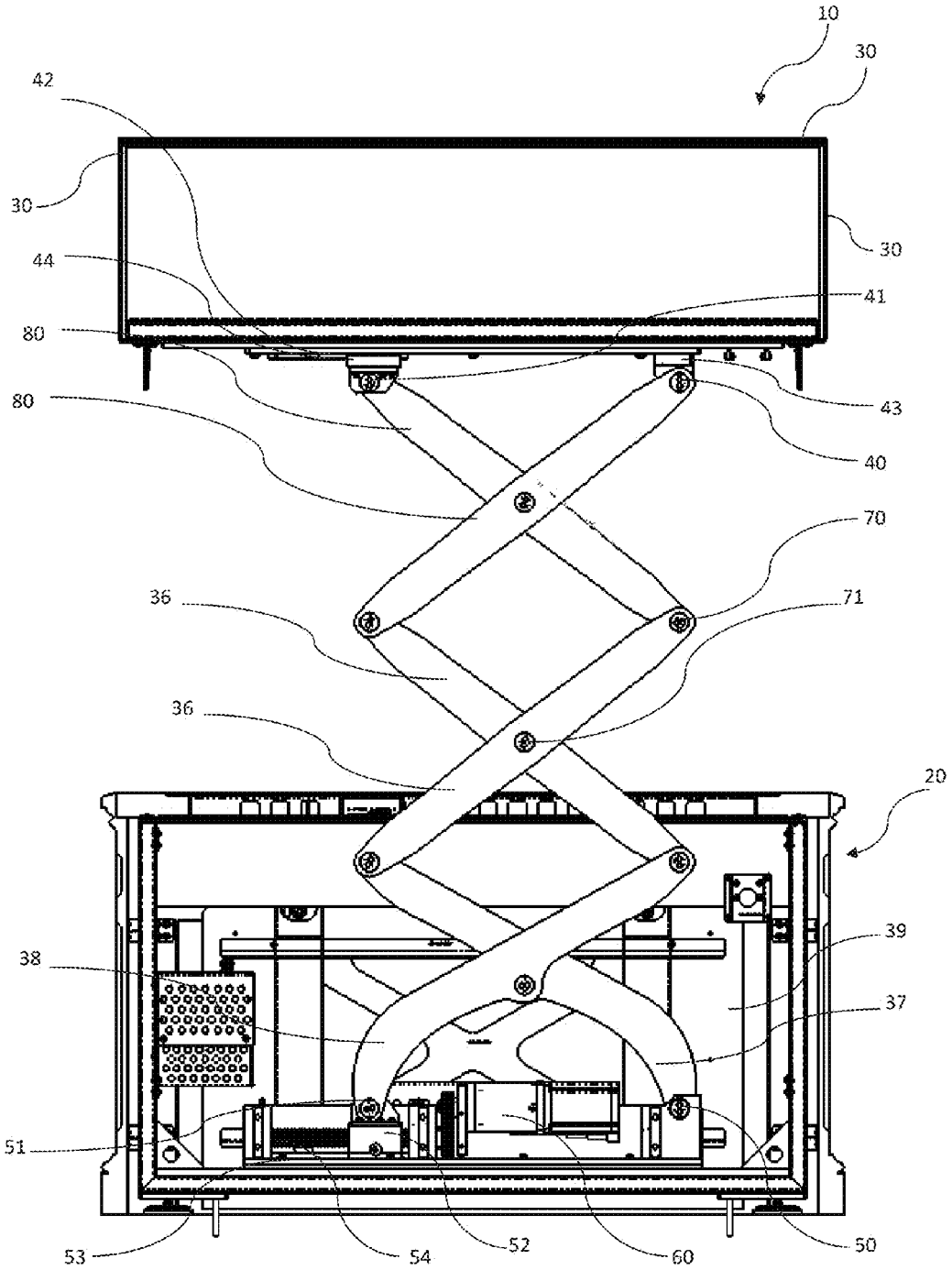
FIG. 3 is a sectional view of the showcase in FIG. 1 with one of the pantograph mechanisms in open position.

With particular reference to FIGS. 2 and 3, the pantograph mechanisms 35 comprise arms 36 hinged together in pairs and arms 80 hinged with bell 26. Moreover, the pantograph mechanisms 35 comprise two lower arms 37 and 38, which are hinged with base 20 and have a curvilinear configuration with a concavity facing towards base 20 itself.

In detail, the lower arm 37 is connected to a fixed pin 50, in turn connected to the bottom of base 20. The lower arm 38 is instead connected to a movable pin 51. The movable pin 51 is in turn provided on a nut 52 sliding on a guide 53. The sliding of nut 52 takes place by direct coupling with a screw 54.

Figure 4:
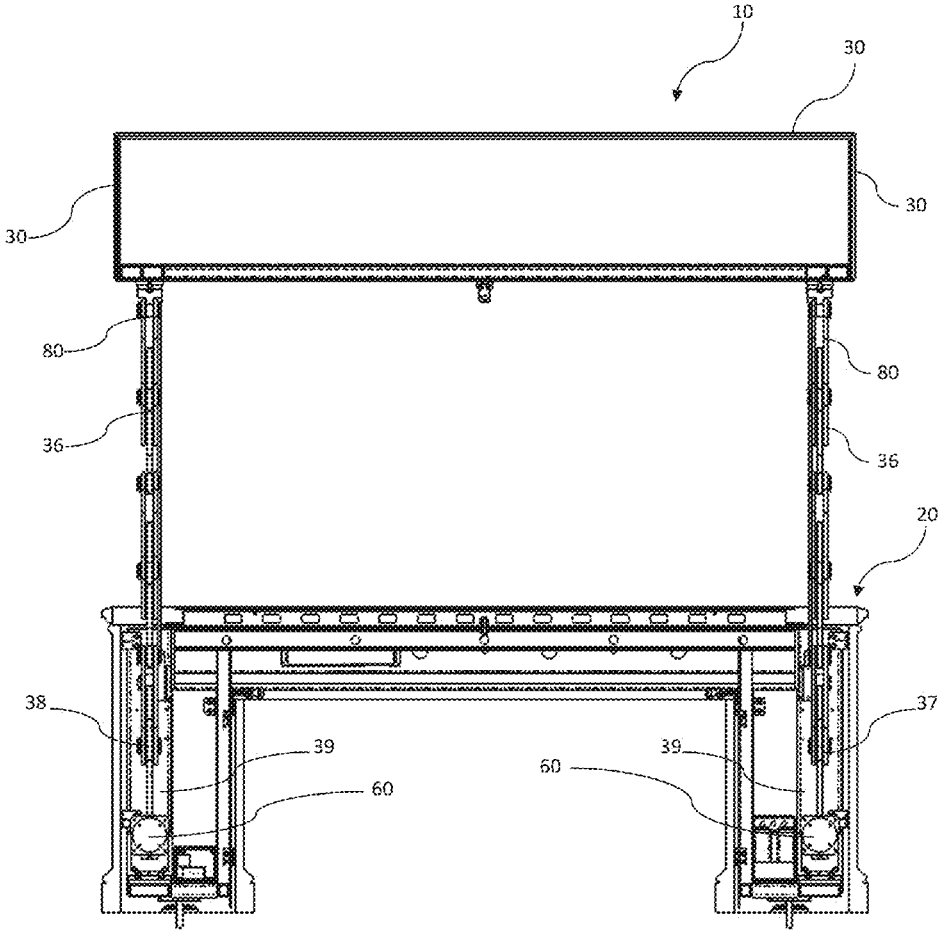
FIG. 4 is a sectional view of the showcase in FIG. 1 with the pantograph mechanism in open position and the lateral end regions in which such mechanisms are housed.

As shown in FIG. 4, base 20 of showcase 10 comprises the two lateral end regions 39 in which the single pantograph mechanisms 35 with the respective actuation systems 60 are placed. The lower arms 37 and 38 of the pantograph mechanisms 35, as said, have a curvilinear configuration with a concavity facing towards base 20. Specifically, with this configuration, the lower arms 37 and 38 close up on the respective actuation system 60, thereby recovering the empty space between the actuation system 60 and the lower arms 37 and 38 and ensuring a smaller footprint in base 20 of the museum showcase 10.

The lower arms 37 and 38 are connected to arms 36 by means of hinges 70 placed in the end portions of the respective arms.

Arms 36 are hinged together in pairs, in the middle portion of each arm 36, by means of a hinge 71. The respective pairs of arms 36 are connected together, in the end portions of each arm 36, by means of hinges 70. The number of pairs of arms 36 used in the pantograph mechanisms 35 depends on the height at which bell 26 is lifted, so as to have a wide opening of showcase 10 for proper placement of the objects of cultural heritage.

Arms 36 are also connected to arms 80 by means of hinges 70 placed in the end portions of the respective arms.

Arms 80 are hinged to bell 26, on the one hand with a fixed pin 40 connected to a support structure 43 in conjunction with bell 26, and on the other hand with a movable pin 41 provided on a sliding block 44 sliding along a guide 42.

The pantograph mechanisms 35 of showcase 10 move simultaneously, both in the opening step and in the closing step of showcase 10. The movement of such mechanisms 35 is a lifting and lowering movement, respectively, of the lower arms 37 and 38, of the pairs of arms 36 and of arms 80 simultaneously; all due to the presence of the actuation systems 60 mentioned above.

As shown in FIG. 2, in the closing step of showcase 10, the sliding motion to the left of nut 52 along guide 53 causes the lowering of the lower arms 37 and 38 and a simultaneous lowering of the pairs of arms 36 and of arms 80 hinged together to form the pantograph mechanism 35. Nut 52 slides on guide 53 by the rotation of screw 54 with which it is coupled.

The lowering of the arms of mechanism 35 also causes the sliding in the same direction of sliding block 44 to which arm 36 is connected by means of the movable pin 41. In this way, showcase 10 is closed.

When showcase 10 is closed, the pantograph mechanisms 35 have arms 80, the pairs of arms 36 and the lower arms 37 and 38 closed on themselves, with the latter enclosing the actuation systems 60 of the single mechanisms 35.

Conversely, as shown in FIG. 3, the sliding motion to the right of nut 52 along guide 53 causes the lifting of the lower arms 37 and 38 and a simultaneous lifting of the pairs of arms 36 and of arms 80 hinged together to form the pantograph mechanism 35. Nut 52 slides on guide 53 by the rotation of screw 54 with which it is coupled in the opposite direction.

The lifting of the arms of mechanism 35 also causes the sliding in the same direction of sliding block 44 to which arm 36 is connected by means of the movable pin 41. In this way, showcase 10 is opened, lifting bell 26 with respect to base 20.

A man skilled in the art could make, without difficulty, changes to the described showcase 10, without however departing from the scope of protection defined by the following claims. For example, pantograph mechanisms 35 with respective actuation systems 60 may be used, placing them in other positions inside base 20. Moreover, the arms may have different lengths or may be hinged together in non-middle positions.

The invention claimed is:

1. A museum showcase comprising:

a base comprising a first actuation system and a second actuation system;

a bell that can be lifted with respect to the base, the bell comprising transparent walls for showcasing objects within the bell;

at least two pantograph mechanisms for lifting the bell, each of the at least two pantograph mechanisms having movable arms hinged together, and including:

i) a pair of lower arms hinged to the base, comprising a first lower arm hinged to the base via a fixed pin, and a second lower arm hinged to the base via a movable pin along the base under control of a respective actuation system of the first and second actuation systems; and ii) a pair of movable arms hinged to the bell;

wherein:

for each of the at least two pantograph mechanisms, the first lower arm and the second lower arm have a curvilinear configuration, said first lower arm and second lower arm forming, in combination, a concavity facing downwards to allow spacing for placement of the respective actuation system between the fixed pin and the movable pin in both a fully retracted and fully extended state of the each of the at least two pantograph mechanisms.

2. The museum showcase according to claim 1, wherein:

the base comprises a substantially flat top portion configured to support the bell in the fully retracted state, and two legs at lateral regions of the base configured to house the at least two pantograph mechanisms and conceal said mechanisms in the fully retracted state.

* * * * *